US009687711B2

(12) United States Patent
Brian

(10) Patent No.: US 9,687,711 B2
(45) Date of Patent: Jun. 27, 2017

(54) HITTER TRAINING DEVICE

(71) Applicant: Jeff Brian, Phoenix, AZ (US)

(72) Inventor: Jeff Brian, Phoenix, AZ (US)

(73) Assignee: Jeffrey S. Brian, Phx, AZ (US)

( * ) Notice: Subject to any disclaimer, the term of this patent is extended or adjusted under 35 U.S.C. 154(b) by 10 days.

(21) Appl. No.: 14/998,889

(22) Filed: Feb. 29, 2016

(65) Prior Publication Data

US 2016/0256760 A1 Sep. 8, 2016

Related U.S. Application Data

(60) Provisional application No. 62/176,957, filed on Mar. 2, 2015.

(51) Int. Cl.

| | |
|---|---|
| ***A63B 69/00*** | (2006.01) |
| *A63B 67/10* | (2006.01) |
| *A63B 102/18* | (2015.01) |

(52) U.S. Cl.

CPC ..... *A63B 69/0002* (2013.01); *A63B 69/0079* (2013.01); *A63B 67/10* (2013.01); *A63B 69/0084* (2013.01); *A63B 2069/0008* (2013.01); *A63B 2102/182* (2015.10); *A63B 2210/50* (2013.01)

(58) Field of Classification Search

CPC ..... A63B 69/0084; A63B 24/0021; A63B 69/0002; A63B 69/206; A63B 69/0079; A63B 69/002; A63B 69/00; A63B 67/10; A63B 2069/0008; A63B 2210/50

USPC ..... 473/426, 422, 451, 430, 429, 423, 428

See application file for complete search history.

(56) References Cited

U.S. PATENT DOCUMENTS

| | | | | | |
|---|---|---|---|---|---|
| 1,554,409 | A * | 9/1925 | Coffee | A63B 69/206 | 473/426 |
| 3,475,026 | A * | 10/1969 | Cooper | A63B 69/0002 | 473/426 |
| 3,729,194 | A * | 4/1973 | Barnett | A63B 69/0084 | 473/426 |
| 4,138,107 | A * | 2/1979 | Janis | A63B 69/0084 | 473/426 |
| 5,056,784 | A * | 10/1991 | Craig | A63B 69/0084 | 473/426 |
| 5,340,101 | A * | 8/1994 | Lawson | A63B 69/0084 | 473/426 |
| 5,766,102 | A * | 6/1998 | Lawson | A63B 69/0084 | 473/428 |
| 6,306,050 | B1 * | 10/2001 | Holder | A63B 69/0002 | 473/421 |

(Continued)

*Primary Examiner* — Mitra Aryanpour

(57) ABSTRACT

A hitter training device is described that is easily transportable, is not bulky, and does not require complex assembly and disassembly. The hitter training device also readily facilitates hitter training for right-handed hitters, for left-handed hitters, or for switch hitters. The device includes a support, a cord, a ball, and a clamp. The support has a first end, a second end, and a mid-section, and the first and second ends are axially offset from the mid-section. The cord is coupled to the support between opposing portions of the support that are axially offset from the mid-section, and has a length such that, when it is coupled to the support, the cord is not taut. The ball is mounted on the cord. The clamp is coupled to the support and is configured to temporarily mount the support, in a releasable manner, to a structure.

20 Claims, 2 Drawing Sheets

(56) References Cited

U.S. PATENT DOCUMENTS

| | | | | |
|---|---|---|---|---|
| 6,514,161 | B1 * | 2/2003 | Minniear | A63B 69/0002 473/423 |
| 7,494,432 | B2 * | 2/2009 | Flanigan | A63B 24/0021 473/422 |
| 7,662,052 | B1 * | 2/2010 | Vidrine | A63B 69/0002 473/417 |
| 7,914,400 | B2 * | 3/2011 | Flading | A63B 69/0002 473/422 |

* cited by examiner

HITTER TRAINING DEVICE

CROSS-REFERENCE TO RELATED APPLICATION(S)

This application claims the benefit of U.S. provisional patent application Ser. No. 62/176,957, filed Mar. 2, 2015, the entire content of which is incorporated by reference herein

TECHNICAL FIELD

The present invention generally relates to training devices, and more particularly relates to a device for training hitters to hit a baseball or a softball.

BACKGROUND

Hitting, whether a baseball or s softball, can be a challenge. Most hitting instructors can agree that the act of hitting can be broken down into at least three areas: mechanics, timing, and vision. Over the years, numerous devices have been developed to help hitters improve in one, two, or all three of these areas. Unfortunately, many of these devices are relatively bulky and/or require assembly and disassembly, and are thus not easily transportable. Moreover, many of these devices do not allow users to simultaneously practice mechanics, timing, and vision.

Hence, there is a need for a portable hitter training device that is easily transportable, is not bulky, and does not require complex assembly and disassembly. The present invention addresses at least this need.

BRIEF SUMMARY

This summary is provided to describe select concepts in a simplified form that are further described in the Detailed Description. This summary is not intended to identify key or essential features of the claimed subject matter, nor is it intended to be used as an aid in determining the scope of the claimed subject matter.

In one embodiment, a hitter training device includes a support, a cord, a ball, and a clamp. The support has a first end, a second end, and a mid-section, and the first and second ends are axially offset from the mid-section. The cord is coupled to the support between opposing portions of the support that are axially offset from the mid-section, and has a length such that, when it is coupled to the support, the cord is not taut. The ball is mounted on the cord. The clamp is coupled to the support and is configured to temporarily mount the support, in a releasable manner, to a structure.

In another embodiment, a hitter training device includes a generally U-shaped support, first and second protective stops, a cord, a ball, and a plurality of clamps. The support has a first end, a second end, and a mid-section, and the first and second ends are axially offset from the mid-section. The first and second protective stops are mounted on the first and second ends, respectively. The cord is coupled to the support proximate the first and second ends, and has a length such that, when it is coupled to the support, the cord is not taut. The ball is mounted on the cord. The clamps are coupled to the support proximate the mid-section and are configured to temporarily mount the support, in a releasable manner, to a structure.

In yet another embodiment, a hitter training device includes a generally U-shaped support, first and second protective stops, a ball, a bushing, and a plurality of clamps.

The support has a first end, a second end, and a mid-section, and the first and second ends are axially offset from the mid-section. The first and second protective stops are mounted on the first and second ends, respectively. The cord is coupled to the support, via a plurality of releasable fasteners, proximate the first and second ends, and the cord has a length such that, when it is coupled to the support, the cord is not taut. The ball has an opening formed therein and through which the cord extends. The bushing is disposed within the opening. The clamps are coupled to the support proximate the mid-section and configured to temporarily mount the support, in a releasable manner, to a structure.

Furthermore, other desirable features and characteristics of the [system/method] will become apparent from the subsequent detailed description and the appended claims, taken in conjunction with the accompanying drawings and the preceding background.

BRIEF DESCRIPTION OF THE DRAWINGS

The present invention will hereinafter be described in conjunction with the following drawing figures, wherein like numerals denote like elements, and wherein.

DETAILED DESCRIPTION

The following detailed description is merely exemplary in nature and is not intended to limit the invention or the application and uses of the invention. As used herein, the word "exemplary" means "serving as an example, instance, or illustration." Thus, any embodiment described herein as "exemplary" is not necessarily to be construed as preferred or advantageous over other embodiments. All of the embodiments described herein are exemplary embodiments provided to enable persons skilled in the art to make or use the invention and not to limit the scope of the invention which is defined by the claims. Furthermore, there is no intention to be bound by any expressed or implied theory presented in the preceding technical field, background, brief summary, or the following detailed description.

Figure 2:
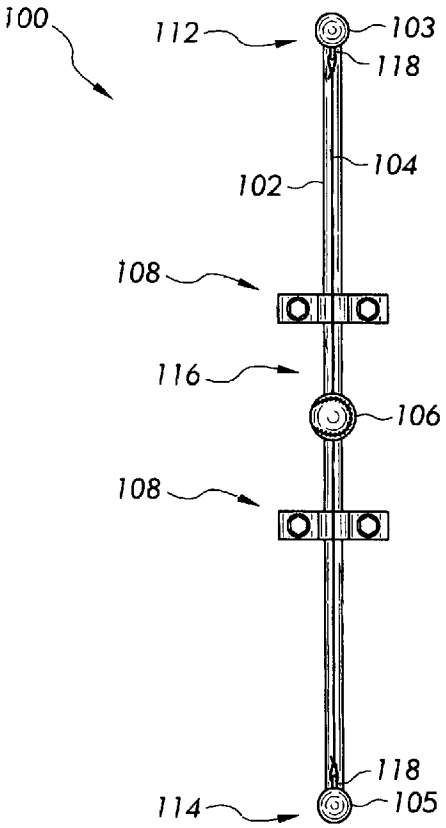
FIG. 2 is a front view of the hitter training device of FIG. 1.
Figure 1:
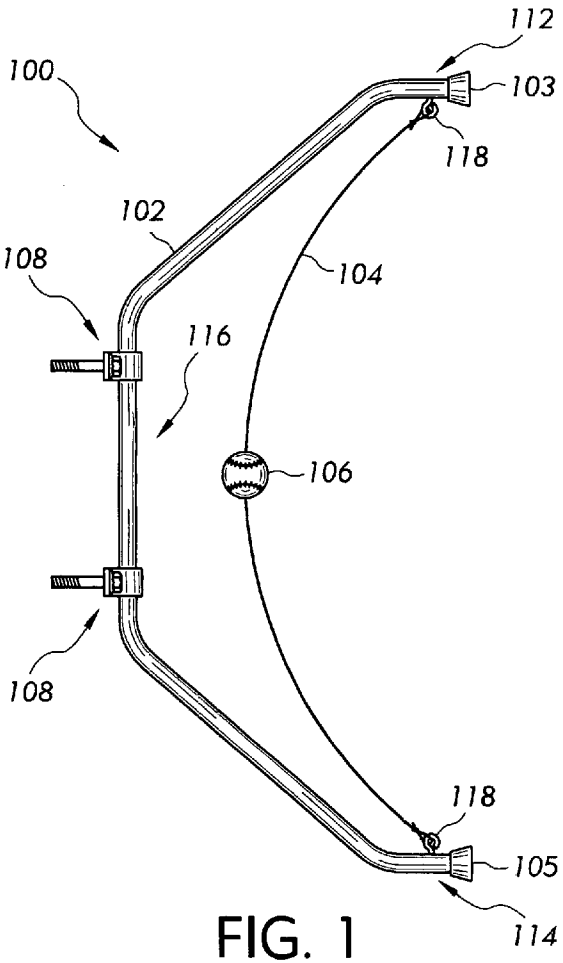
FIG. 1 is a side view of one embodiment of a hitter training device.

Referring to FIGS. 1 and 2, side and front views of an embodiment of a hitter training device 100 are depicted. The depicted device 100 includes a support 102, a cord 104, a ball 106, and one or more clamps 108. The support 102 has a first end 112, a second end 114, and a mid-section 116. The first and second ends 112, 114 are axially offset from the mid-section 116. As such, the support 102, or at least a portion thereof, is a non-linear shape. In the depicted embodiment, the support is generally U-shaped. The depicted embodiment additionally has first and second protective stops 103, 105 are mounted on the first and second ends 112, 114, respectively. It will be appreciated that these stops 103, 105 are optional.

The cord 104 is coupled to the support 102 between opposing portions of the support 102 that are axially offset from the mid-section 116. In the depicted embodiment, the cord 104 is coupled to the support proximate the first and second ends 112, 114, though other portions could also be used. Regardless of the specific portions, the cord 104 has a length such that, when it is coupled to the support, it is not taut. Rather, as FIG. 1 depicts, there is some slack in the cord 104. The amount of slack may vary, but is limited so that when the training device 100 is used, as will be described further below, the ball 106 does not strike the support 102.

It will be appreciated that the cord 104 may be variously implemented and may be formed of various materials. For example, it may be a single- or multi-strand rope, a single- or multi-strand strap, a bungee cord, or any one of numerous other types of cords made of any one of numerous types of materials suitable for supporting the ball 106. It will additionally be appreciated that the cord 104 is preferably coupled to the support 102 via a plurality of fasteners 118. The fasteners 118 may be coupled to the support 102, coupled to the cord 104, or coupled to both. Moreover, one or more of the fasteners 118 may be releasable type fasteners, allowing for one or both ends of the cord 104 to be readily released decoupled from the support 102.

The ball 106 is mounted on the cord 104. The ball 106, which may be a softball, a baseball, or any one of numerous other types of balls, may be mounted on the cord 104 in a permanent manner or in a releasable manner, using any one of numerous mounting techniques. In the depicted embodiment, the ball 106 is mounted on the cord 104 via an opening that is formed in the ball 106, allowing the cord 104 to extend through the ball 106. It will be appreciated that one or more bushings (not depicted) may, if needed or desired, be disposed within the opening.

The clamps 108 are coupled to the support 102, and more particularly to the mid-section 116 of the support 102. The clamps 108, which may be variously configured and implemented, are configured to allow the support 102 to be temporarily mounted, in a releasable manner, to another device or structure, such as a pole, a tree, a stake, or any one of numerous other permanent or temporary devices or structures. Although the depicted embodiment includes two clamps 108, it will be appreciated that the device 100 could be implemented with more or less than this number of clamps.

Figure 3:
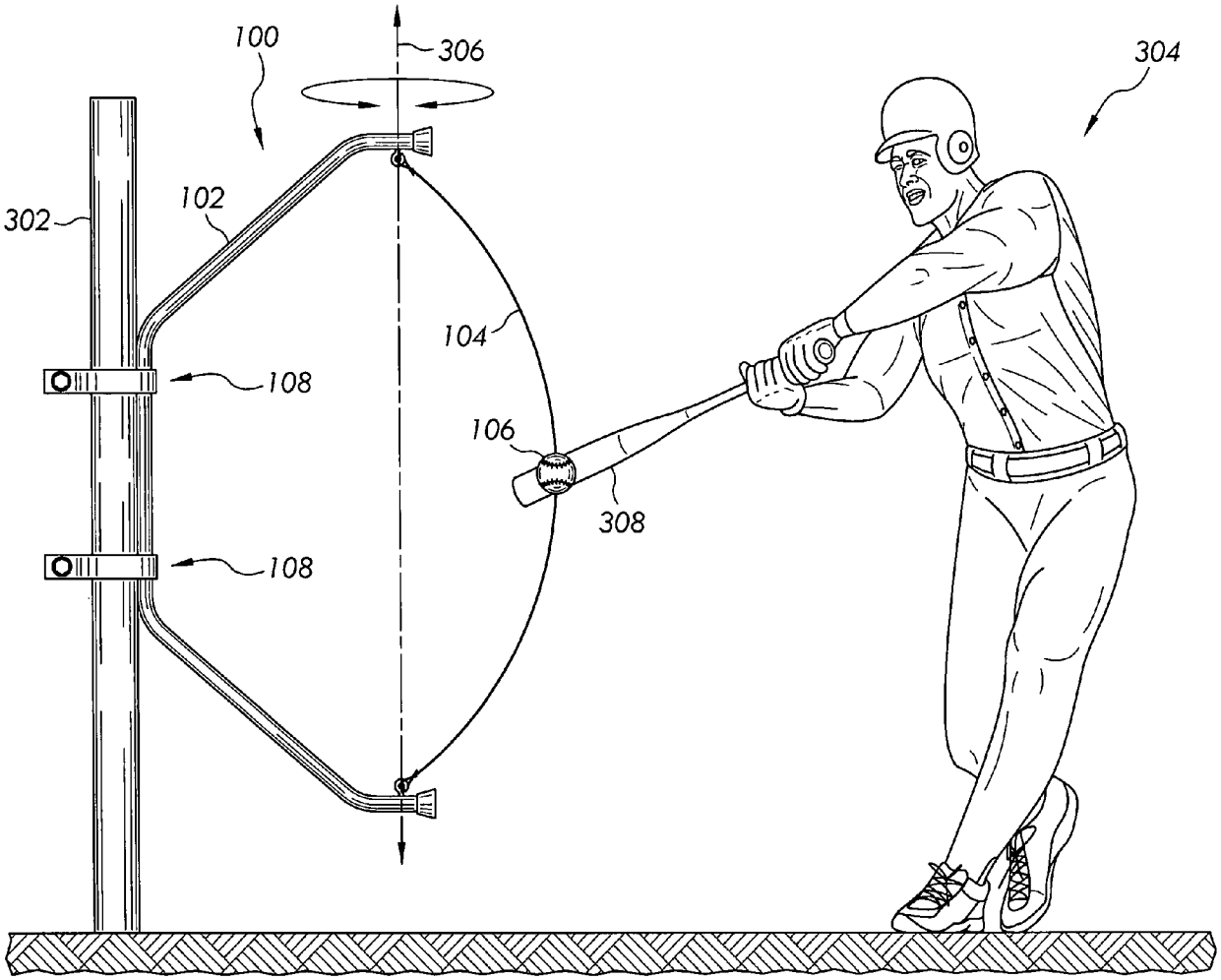
FIG. 3 depicts the hitter training device of FIGS. 1 and 2 mounted for use by a user.

Turning now to FIG. 3, it may be seen that the hitter training device 100, when used, is preferably mounted, as noted above, to a mount device or structure 302, via the one or more clamps 108. If not already done, the cord 104, with the ball mounted thereon, is then coupled to the support 102. A user 304 may then manually cause the ball 106 to rotate, at a desired rotational speed, in a desired rotational direction and about a rotational axis 306 that extends between the points on the structure 102 to which the cord 104 is coupled. While the ball 106 is rotating, the user 304 may then strike the ball 106 using a bat 308 (or other suitable device).

As may be appreciated, when the ball 106 is struck by the bat 308, it will then rotate in the opposite direction about the rotational axis 306 for a period of time. During this rotation, the user 304 may change their batting stance and once again strike the ball 106 with the bat 308, thereby allowing the user 304 to practice switch hitting. Alternatively, the user 304 may wait for the ball 106 to cease rotating, or to slow to a sufficient rotating speed to allow it to be manually stopped, and then begin rotating the ball 106 once again in the first rotational direction. In another alternative, a second user (not depicted) could stand opposite the user 304 and strike the ball 106 in the opposite direction.

When the user 304 has completed their practice, the device 100 may be easily removed from the mount device or structure 302, and transported, by hand, for storage.

The hitter training device 100 described herein is easily transportable, is not bulky, and does not require complex assembly and disassembly. The hitter training device 100 described herein also readily facilitates hitter training for right-handed hitters, for left-handed hitters, or for switch hitters.

In this document, relational terms such as first and second, and the like may be used solely to distinguish one entity or action from another entity or action without necessarily requiring or implying any actual such relationship or order between such entities or actions. Numerical ordinals such as "first," "second," "third," etc. simply denote different singles of a plurality and do not imply any order or sequence unless specifically defined by the claim language. The sequence of the text in any of the claims does not imply that process steps must be performed in a temporal or logical order according to such sequence unless it is specifically defined by the language of the claim. The process steps may be interchanged in any order without departing from the scope of the invention as long as such an interchange does not contradict the claim language and is not logically nonsensical.

Furthermore, depending on the context, words such as "connect" or "coupled to" used in describing a relationship between different elements do not imply that a direct physical connection must be made between these elements. For example, two elements may be connected to each other physically, electronically, logically, or in any other manner, through one or more additional elements.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention. It being understood that various changes may be made in the function and arrangement of elements described in an exemplary embodiment without departing from the scope of the invention as set forth in the appended claims.

What is claimed is:

1. A hitter training device, comprising:

a support having a first end, a second end, and a mid-section, the first and second ends axially offset from the mid-section;

a cord coupled to the support between opposing portions of the support that are axially offset from the mid-section, and having a length such that, when the cord is coupled to the support, the cord is not taut;

a ball mounted on the cord; and a clamp coupled to the support and configured to temporarily mount the support, in a releasable manner, to a structure.

2. The device of claim 1, wherein the support is non-linearly shaped.

3. The device of claim 2, wherein the support is U-shaped.

4. The device of claim 1, further comprising first and second protective stops mounted on the first and second ends, respectively.

5. The device of claim 1, wherein the cord is coupled to the support proximate the first and second ends.

6. The device of claim 1, wherein the cord is one of a single-strand rope, a multi-strand rope, a single-strand strap, a multi-strand strap, or a bungee cord.

7. The device of claim 1, wherein the cord is coupled to the support via a plurality of fasteners.

8. The device of claim 7, wherein the fasteners are configured as releasable fasteners.

9. The device of claim 1, wherein the ball is one of a softball or a baseball.

10. The device of claim 1, wherein the ball is permanently mounted on the cord.

11. The device of claim 1, wherein the ball is releasably mounted on the cord.

12. The device of claim 1, wherein the ball has an opening through which the cord extends.

13. The device of claim 12, further comprising a bushing disposed within the opening.

14. The device of claim 1, wherein the clamp is coupled proximate the mid-section of the support.

15. A hitter training device, comprising:

a generally U-shaped support having a first end, a second end, and a mid-section, the first and second ends axially offset from the mid-section;

first and second protective stops mounted on the first and second ends, respectively;

a cord coupled to the support proximate the first and second ends, the cord having a length such that, when the cord is coupled to the support, the cord is not taut;

a ball mounted on the cord; and a plurality of clamps coupled to the support proximate the mid-section and configured to temporarily mount the support, in a releasable manner, to a structure.

16. The device of claim 1, wherein the cord is one of a single-strand rope, a multi-strand rope, a single-strand strap, a multi-strand strap, or a bungee cord.

17. The device of claim 1, wherein the cord is coupled to the support via a plurality of releasable fasteners.

18. The device of claim 1, wherein the ball is one of a softball or a baseball.

19. The device of claim 1, wherein:

the ball has an opening through which the cord extends; and the device further comprises a bushing disposed within the opening.

20. A hitter training device, comprising:

a generally U-shaped support having a first end, a second end, and a mid-section, the first and second ends axially offset from the mid-section;

first and second protective stops mounted on the first and second ends, respectively;

a cord coupled to the support, via a plurality of releasable fasteners, proximate the first and second ends, the cord having a length such that, when the cord is coupled to the support, the cord is not taut;

a ball having an opening formed therein and through which the cord extends;

a bushing disposed within the opening; and a plurality of clamps coupled to the support proximate the mid-section and configured to temporarily mount the support, in a releasable manner, to a structure.

* * * * *